United States Patent [19]

Koinuma et al.

[11] 4,338,545

[45] Jul. 6, 1982

[54] MAGNETRON UNIT WITH A MAGNETIC FIELD ADJUSTING MEANS

[75] Inventors: Tokuju Koinuma, Kawasaki; Hisao Saito, Yokohama; Heihachi Miura, Kawasaki, all of Japan

[73] Assignee: Tokyo Shibaura Denki Kabushiki Kaisha, Kawasaki, Japan

[21] Appl. No.: 123,949

[22] Filed: Feb. 25, 1980

[30] Foreign Application Priority Data

Feb. 28, 1979 [JP] Japan ..... 54-23193

[51] Int. Cl.[3] ..... H01J 25/50

[52] U.S. Cl. ..... 315/39.71; 313/46; 313/151; 315/39.51; 315/39.75

[58] Field of Search ..... 315/39.51, 39.71, 39.75; 313/40, 45 , 151, 46

[56] References Cited

U.S. PATENT DOCUMENTS

| | | | |
|---|---|---|---|
| 2,429,295 | 10/1947 | Quitter | 315/39.59 |
| 2,449,090 | 9/1948 | Spencer | 315/39.59 |
| 2,452,078 | 10/1948 | Spencer | 315/39.59 |
| 2,806,178 | 9/1957 | Litton et al. | 315/39.71 X |
| 2,957,100 | 10/1960 | Espersen et al. | 315/39.71 X |
| 4,027,194 | 5/1977 | Yamano et al. | 315/39.71 |
| 4,063,129 | 12/1977 | Miura et al. | 315/39.71 |
| 4,223,246 | 9/1980 | Osepchuk | 315/39.71 |

FOREIGN PATENT DOCUMENTS

| | | | |
|---|---|---|---|
| 50126521 | 4/1977 | Japan | 315/39.71 |
| 53-57741 | 5/1978 | Japan | 315/39.51 |
| 227424 | 1/1924 | United Kingdom | 315/39.51 |
| 292499 | 5/1928 | United Kingdom | 315/39.51 |
| 504435 | 4/1939 | United Kingdom | 315/39.51 |
| 901828 | 9/1958 | United Kingdom | 315/39.51 |
| 1074587 | 4/1964 | United Kingdom | 315/39.51 |
| 1292073 | 10/1972 | United Kingdom | 315/39.51 |
| 232394 | 8/1969 | U.S.S.R. | 315/39.71 |

*Primary Examiner*—Saxfield Chatmon, Jr.

*Attorney, Agent, or Firm*—Cushman, Darby & Cushman

[57] ABSTRACT

A magnetron unit is provided with anode cylinder with a number of vanes defining resonance cavities, and a cathode disposed along the axis of the anode cylinder. An axial interaction space into which a magnetic field is developed is disposed between the vanes and the cathode. Provided is a pair of main pole pieces with the interaction space located therebetween to supply the magnetic field into the interaction space. Permanent magnet members are magnetically coupled with the pair of the main pole pieces for supplying magnetic energy to the main pole pieces. The permanent magnet members are magnetically coupled with each other by a yoke. Auxiliary pole pieces are disposed at the top ends of the main pole pieces at a given interval. The auxiliary pole pieces are supported by bimetal members fixed to them. When the temperature of the permanent magnet member, the bimetallic members rises moves the auxiliary pole pieces toward the interaction space. A reduction of the magnetomotive force of each permanent magnet member is offset by a reduction of the interval between the pair of the auxiliary pole pieces.

7 Claims, 31 Drawing Figures

MAGNETRON UNIT WITH A MAGNETIC FIELD ADJUSTING MEANS

The invention relates to a magnetron unit with an adjusting means for adjusting the magnetic field intensity within the magnetron unit and, more particularly, a magnetron unit with an adjusting means for adjusting the intensity of a magnetic field in an interaction space within an anode cylinder in accordance with the temperature of permanent magnet members.

Generally, a magnetron unit includes a pair of permanent magnet members. The temperature of the permanent magnet members is raised by anode losses during operation of the magnetron unit. As the temperature of the permanent magnet members increase, the magnetic energy of the permanent magnet members decreases. Alnico magnets and ferrite magnets, which have been widely used for the permanent magnet members of the magnetron unit, have reversible temperature coefficients of residual flux density approximately-0.02%/°C. and-0.2%/° C. respectively. These reversible temperature coefficients reveal that magnetic energy from a ferrite magnet depends largely on temperature, compared to that for the alnico magnet. Accordingly, in a magnetron unit with a pair of ferrite magnet members, the intensity of the axial magnetic field generated in the interaction space decreases more greatly with rise of temperature within the anode cylinder. This greatly changes the performance of the magnetron unit. A magnetron device with the magnetron unit generally uses a leakage transformer for increasing power source impedance to make the anode current uniform. In the magnetron device, when temperature within the anode cylinder rises, the anode current increases due to the characteristic of the magnetron unit, possibly resulting in a decrease of an anode voltage due to the characteristic of the leakage transformer. The increased anode current frequently burns the leakage transformer or the decreased anode voltage reduces a microwave output of the magnetron unit.

Accordingly, an object of the invention is to provide a magnetron unit wherein the intensity of the magnetic field in an interaction space is substantially constant irrespective of a change of temperature and thereby the performance of the magnetron unit is stabilized.

According to the invention there is provided a magnetron unit comprising:

an anode cylinder provided with a number of resonance cavities defined therein;

a cathode disposed within and along the anode cylinder an interaction space being defined between the anode cylinder and the cathode;

at least one pole piece disposed within the anode cylinder for supplying a magnetic field into the interaction space;

a cover means for hermetically sealing the anode cylinder;

at least one permanent magnet member magnetically coupled with the pole piece and disposed outside the anode cylinder;

magnetic coupling means for forming a magnetic circuit having the permanent magnet member, the pole piece and interaction space;

means for adjusting a magnetic resistance or reluctance including the magnetic circuit by giving a mechanical deformation in the magnetic circuit in accordance with temperature of the magnet member, the magnetic resistance adjusting means keeping substantially constant and intensity of a magnetic field in the interaction space irrespective of a temperature of the magnet member.

Other objects and features of the invention will be apparent from the following description taken in connection with the accompanying drawings, in which.

Figure 1:
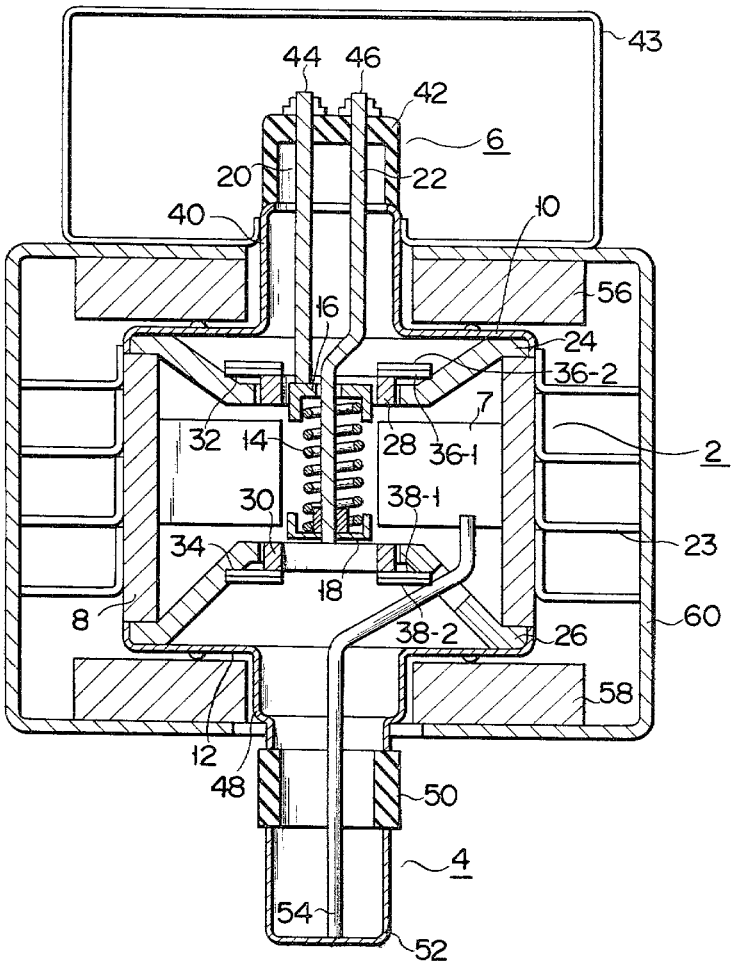
FIG. 1 is a longitudinal sectional view of an embodiment of a magnetron unit according to the invention.

Referring to FIG. 1, there is shown an embodiment of a magnetron unit according to the invention. As is well known, the magnetron unit shown in FIG. 1 is of the external magnet type, and has a magnetron body 2, a microwave output section or an antenna section 4 coupled with the magnetron body 2, and a cathode stem section 6 for supplying electric power to the magnetron body 2. An anode cylinder 8 of the magnetron body 2 is hermetically sealed at both end openings by cover plates 10 and 12 on which the microwave section 4 and the cathode section 6 are hermetically mounted. Within an anode cylinder 8, a number of vanes 7 are radially disposed to form resonance cavities each between the adjacent vanes. Those vanes are coupled with one another by ring-like straps (not shown) every two vanes. Interaction spaces are formed between the vanes 7. A direct-heated coil-shaped cathode 14 is disposed within and along the anode cylinder 8. An interaction space is also formed between the cathode 14 and the anode vanes 7. The cathode 14 is fixed at both ends to end hats 16 and 18 of molybdenum, for example, which are supported by rod cathode holders 20 and 22 extending along the axis of the anode cylinder 8. A plurality of cooling fins 23 to cool the magnetic body 2 are disposed around the anode cylinder 8. Pole pieces 24 and 26 are mounted to one and the other ends of the anode cylinder 8. The pole pieces 24 and 26 have holes at the centers an curved inwardly to be close to an electron interaction space at the same place, as shown in the drawing. Accordingly, each pole piece is shaped like a funnel, as shown. Auxiliary pole pieces 28 and 30 as magnetic rings, for example, are slidably disposed within the holes of the pole pieces 24 and 26. The auxiliary pole pieces 28 and 30 are suported by the main pole pieces 24 and 26 with intervention of rectangular bimetallic plates 32 and 34, respectively. The bimetallic plates 32 and 34 are formed by bonding two different members 36-1 and 36-2, and 38-1 and 38-2. The bimetallic members 36-1 and 38-1 facing an electron space are made of low expansion metal while the plates 36-2 and 38-2 facing the cover plates 10 and 12 are made of high expansion metal: lengths extending from the end surfaces of the auxiliary pole pieces 28, 30 to the interaction space have the same as that of the pole pieces 24 and 26 at room temperature.

The cover plate 10 is provided with a cylindrical housing 40 integral with the cathode step section 6. Within the cylindrical housing 40, the rod cathode holders 20 and 22 extend therealong and are fixed to a cathode stem cap 42 fixed at the opening of the cylindrical housing 40. The end portions of the holders 20 and 22 projected from the cathode step cap 42 serve as cathode terminals 44 and 46. Disposed within a shield box 43 are the cathode stem 6 and a filter element (not shown) for restricting noise. The cover plate 12 is provided integrally with a cylindrical housing 48 of the output section 4. The opening of the cylindrical housing 48 is sealed by the combination of a ring member 50 of dielectric material and a metal cap 52. A microwave output conductor 54 electrically connected to one of vanes 7 is connected to the metal cap 52. Disposed outside the magnetron body 2 are a ring like ferrite permanent magnet member 56 with a hole in which the cathode stem section 6 is inserted and a ring-like ferrite permanent magnet member 58 with a hole in which the microwave output section 4 is inserted. Those permanent magnet members are magnetically coupled with each other by a frame magnetic yoke 60. The magnets 56 and 58, the main pole pieces 24 and 26, the auxiliary pole pieces 28 and 30, the interaction space between the pole pieces 24 and 28, and 26 and 30, cooperate to form a magnetic circuit. A magnetic field is generated into a space defined between the pole pieces 24 and 28, and 26 and 30.

With such a construction, the auxiliary pole pieces 28 and 30 and bimetal plates 32 and 34 act to adjust an intensity of a magnetic field within the interaction space in accordance with temperature of the permanent magnet members 56, 58, that is to say, it adjusts a magnetic resistance or a reluctance of the magnetic circuit including the magnet members 56 and 58, the pole pieces 24, 26, 28 and 30, and the magnetic yoke 60 in accordance with the temperature of the permanent magnet members 56, 58. During the oscillation of the magnetron unit, an anode loss by the vanes 7 generates heat which is radiated through the cooling fin 23 fixed to the anode cylinder 8; however, part of the heat is transmitted through the pole pieces 24 and 26 and the cover plates 10 and 12 and through the cooling fin 23 and the magnetic yoke 60 to the permanent magnet members 56 and 58. The heat transmitted reduces a magnetomotive force of the permanent magnets members due to its temperature characteristic. The heat is also transmitted to the bimetallic plates 32 and 34 through the pole pieces 24 and 26. The bimetallic plates 32, 34 are deformed to the electron interaction space by the heat transmitted to the plates 32, 34. The deformation of the bimetallic plates 32 and 34 also moves the auxiliary pole pieces 28 and 30 fixed to the tip of the bimetallic plates 32 and 34 toward the electron interaction space. As a result, the magnetic pole piece interval is substantially narrowed to intensify an axial magnetic field in the electron interaction space. The intensified magnetic field offsets the reduction of the magnetomotive force of the permanent magnet members 56 and 58 as previously stated. In short, when the magnetomotive force of the permanent magnet members 56 and 58 reduces with the rise of the temperature, the interval between the auxiliary magnetic pieces 28 and 30 shortens to reduce the magnetic resistance, or the reluctance. As a result, the magnetic field in the interaction space between magnetic pieces 28 and 30 is kept substantially constant and the oscillation of magnetron unit is stable irrespective of the temperature therewithin.

In the embodiment as mentioned above, when the length and thickness of the bimetallic plates 32 and 34 are appropriately selected, an intensity of a magnetic field in the electron interaction space in a high temperature and stable condition of the oscillating magnetron unit may be set to substantially equal that in a normal temperature state. Accordingly, it is possible that the anode voltage in a normal temperature may equal to that in the high temperature and stable condition.

In the above-mentioned embodiment, a pair of auxiliary pole pieces 28 and 30 and a pair of bimetallic plates 32 and 34 are provided in corresponding to a pair of the main pole pieces 24 and 26. Alternatively, a single auxiliary pole piece 28 or 30 and a single bimetallic plate 32 or 34 may be provided for a single main pole piece 24 or 26.

Figure 2:
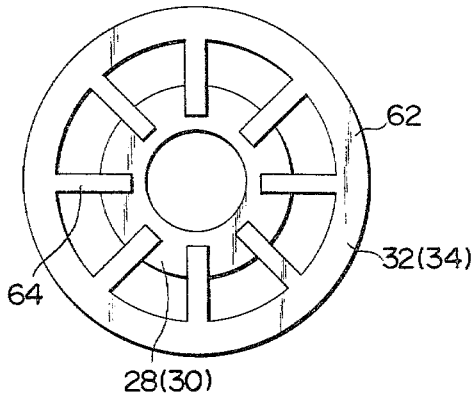
FIGS. 2 and 3 are a plan view and a cross sectional view of a bimetallic plate used in the magnetron unit shown in FIG. 1.
Figure 3:
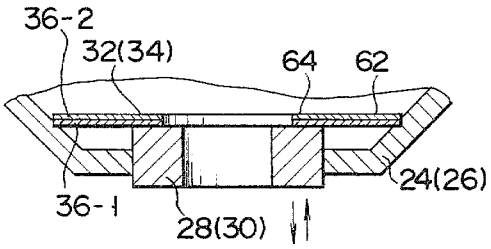

A first modification of the bimetallic plate 32 (34) with a rectangular shape used in the above-mentioned embodiment is illustrated in FIGS. 2 and 3. The bimetallic plate 32 (34) in this modification includes a ring-like peripheral portion 62 at its peripheral edge fixed to the main pole piece 24 or 26, and radial extending portions 64 extending from the peripheral portion 62 toward the center at their end portions fixed to the auxiliary pole piece 28 (30). The auxiliary pole piece 28 or 30 is slidably fitted within the hole of the main pole piece 24 or 26 to lower the magnetic resistance between the main and auxiliary pole pieces.

Figure 4:
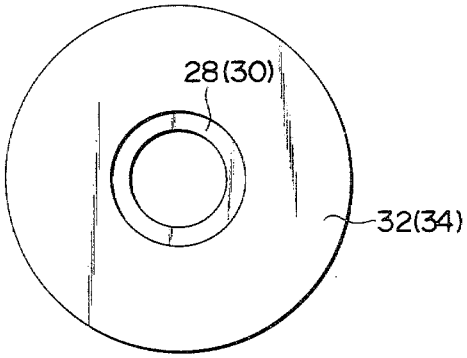
FIGS. 4 and 5 are a plan view and a cross sectional view of a modification of the bimetallic plate.
Figure 5:
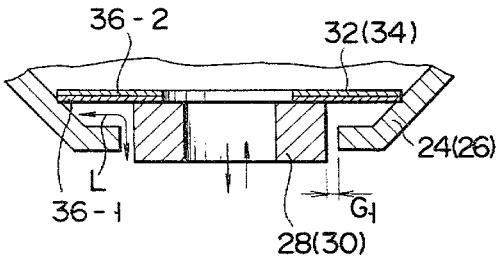

A second modification of the bimetallic plate 32 (34) used in the first embodiment as mentioned above is illustrated in FIGS. 4 and 5. The second modification is shaped like a ring, with the inner peripheral portion fixed to the auxiliary piece 28 (30) and with the outer peripheral portion fixed to the main pole piece 24 (26).

In the first or second modification, the space between the main and auxiliary pole pieces 24 (26) and 28 (30), and the bimetallic plate 32 (34) may be constituted as a choke element with some physical modification specified below. That is, a gap G between the main pole piece 24 (26) and the auxiliary pole piece 28 (30) is selected to be a relatively wide, 0.5 mm. A distance L from the inner surface of the main pole piece 26 to the gap opening is selected to be $\lambda/4$ of a high harmonic frequency with a wave length $\lambda$. The choke element thus formed can suppress leakage of high harmonic waves of the oscillating signal. In this embodiment, the bimetallic plates 32 and 34 is preferably made of magnetic material to minimize the magnetic loss and the magnetic resistance between the main and auxiliary magnetic pole piece.

Figure 6:
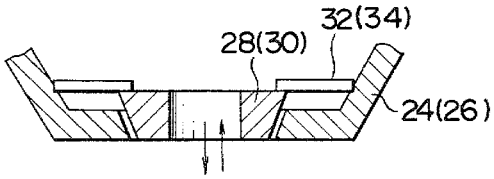
FIG. 6 is a cross section view of a modification of the structure of the main and auxiliary pole pieces.

An additional modification is allowed in which the surfaces of the main pole piece 24 (26) and the auxiliary pole piece 28 (30), confronting with each other, are tapered, as shown in FIG. 6. This feature is advantageous in that, when the auxiliary pole piece 28 (30) moves toward the electron interaction space, it comes in contact with the pole piece 24 (26), so that the distance between the magnetic poles is not narrowed farther beyond that thereby to prevent an excessive strength of the magnetic field intensity in the interaction space.

The bimetallic plates used in the above-mentioned embodiment and modifications may be substituted by trimetallic plates.

Figure 7:
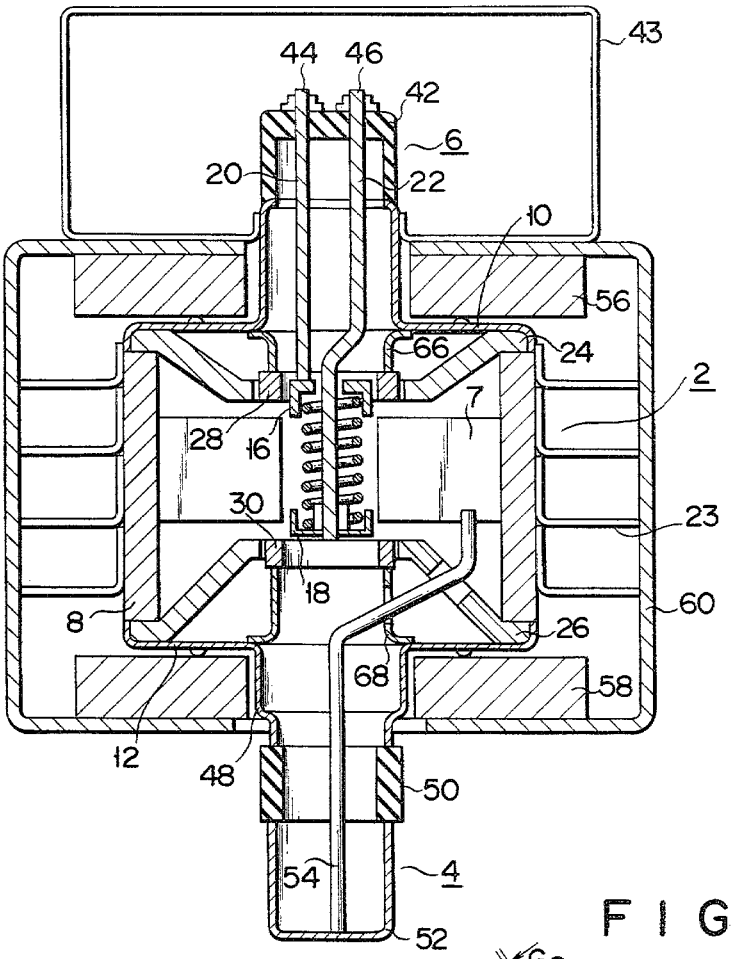
FIG. 7 is a longitudinal sectional view of another embodiment of the magnetron unit according to the invention.

Another embodiment of the magnetron unit according to the invention will be described referring to FIGS. 7 and 8. The second embodiment may attain similar effects to those of the first embodiment. As shown, auxiliary pole pieces 28 and 30, for example, magnetic rings, are disposed in holes located at the central portions of main pole pieces 24 and 26, respectively. The auxiliary pole pieces 28 and 30 are supported by cover plates 10 and 12, through metal cylinders 66 and 68 with relatively large thermal expansion, for example, stainless steel or copper, and is thermally coupled with an anode cylinder 8. The metal cylinder 68 closer to the output section 4 is provided with a cut away portion through which an output conductor 54 passes. The distance between the auxiliary pole pieces 28 and 30 is the same as the distance between the main pole pieces 24 and 26, at normal temperature. The end surfaces of the pole pieces 28 and 24 or 30 and 26, which face the interaction space, are aligned with a same plane at room temperature.

In operation, most of the heat due to the anode loss of the magnetron is radiated by a cooling fin 23 fixed around the anode cylinder 8. Part of the heat, however, is transmitted to permanent magnet members 56 and 58, through the cover plates 10 and 12 or the magnetic yoke 60. As a result, the permanent magnet members 56 and 58 have reduced electromotive forces due to their temperature characteristics. The heat is transferred through the cover plates 10 and 12 to the metal cylinders 66 and 68. Since the metal cylinders 66 and 68 are made of metal with relatively large expansion such as stainless steel or copper, the heat transmitted expands the metal cylinders 66 and 68 longitudinally, so that the auxiliary pole pieces 28 and 30 fixed at the tips of the metal cylinders 66 and 68 are moved toward the electron interaction space. As a result, the interval between the magnetic poles are substantially narrowed to intensify a magnetic field in the electron interaction space, and the intensified magnetic field compensates for the reduction of the magnetic field intensity. The metal cylinders 66 and 68 may be located at any place where they can transmit heat most effectively. Accordingly, one end of the metal cylinders 66, 68 may not be supported by the cover plates 10, 12. A space enclosed by the pole pieces 24 or 28, the cover plates 10 and 12, the metal cylinders 66 and 68, and the auxiliary pole pieces 28 and 30, may be formed to have a given choke by appropriately selecting the position where the metal cylinders 66 and 68 are supported, and the gaps between the auxiliary pole pieces 24 and 28, and the main pole pieces 24 and 26.

Figure 8:
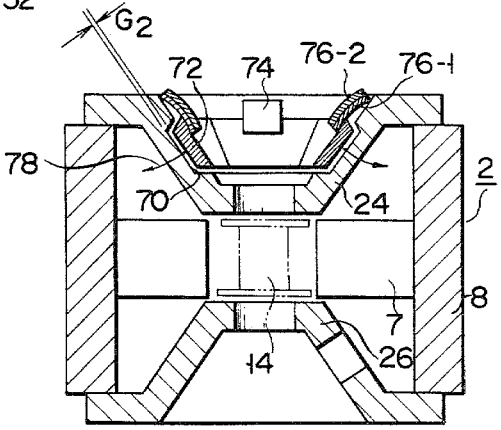
FIG. 8 is a longitudinal sectional view of yet another embodiment of the magnetron unit according to the invention.

Still another embodiment of the magnetron unit of the invention is illustrated in FIG. 8. Some grooves 70 are formed on the inner surface of the main pole piece 24 close to the cathode stem 6. The auxiliary pole piece 72 is fitted in the groove 70, having a shape fitted the groove. The pole piece 72 is supported by a bimetallic plate 74 so as to provide a gap between it and the main pole piece 10 at normal temperature. The bimetal plate 74 is formed by bonded metal plates 76-1 and 76-2 with different thermal expansions, with the metal plate having a low thermal expansion facing the main pole piece 24 and the metal plate having a high thermal expansion facing the axis of the magnetron unit. In FIG. 8, only the magnetron body 2 is illustrated with omission of the cover plates and cathode holders and with the cathode end hats indicated by dotted lines, for easy of illustration.

In operation, heat transmitted through the anode cylinder 8, and the pole piece 24 bends the bimetallic plate 74 toward in the direction of an arrow 78, so that a gap G2 between the auxiliary pole piece 72 and the main pole piece 24 becomes narrowed, resulting in decrease of the magnetic resistance of the magnetic circuit. Therefore, the magnetic field developed into the electron interaction space is intensified to compensate for the reduction of the magnetomotive force due to temperature rise of the magnet.

Figure 9:
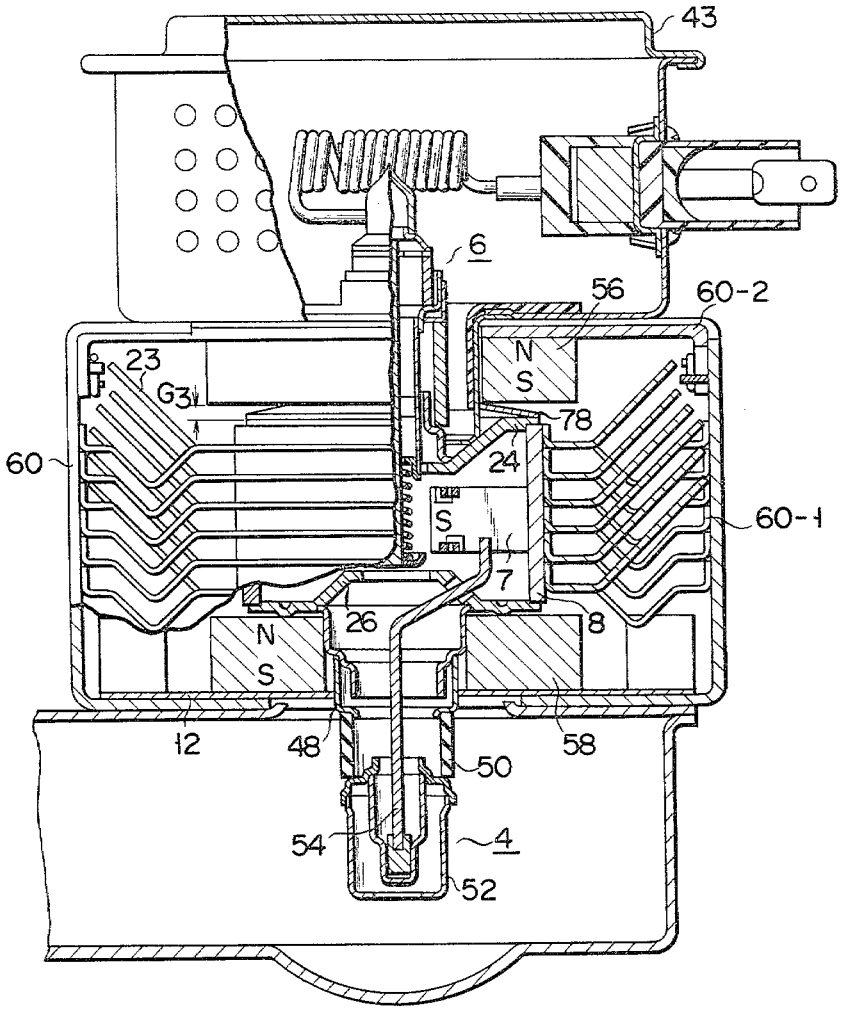
FIG. 9 is a partial cross sectional view of still another embodiment of the magnetron unit according to the invention.
Figure 10:
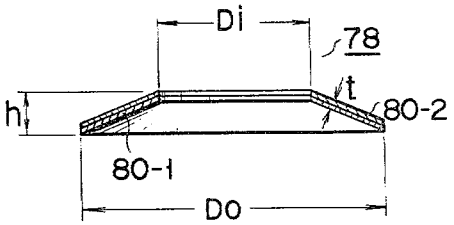
FIGS. 10 and 11 are a cross sectional and a plan view of the bimetallic plate or member used in the magnetron unit in FIG. 9.
Figure 11:
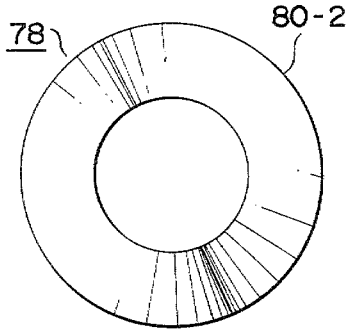

FIG. 9 shows an additional embodiment of the magnetron unit according to the invention. In the embodiment, either of permanent magnet members 56 and 58 is movable with temperature change. Reluctance of the magnetic circuit including a pair of the permanent magnets members 56 and 58, pole pieces 24 and 26, a magnetic yoke 60, and an interaction space, is adjusted in accordance with temperature. A bimetallic member 78 is provided between a ferrite permanent magnet member 56 disposed around the cathode stem 6 and the pole piece 24 magnetically coupled with the permanent magnet member 56, thereby to form gap G3. The bimetallic member 78 is preferably formed by bonding a pair of plates. One of the plates is preferably made of ferromagnetic material and have a high thermal expansion coefficient while the other plate has a low thermal expansion coefficient. The bimetallic member is shaped like a dish with a hole at the central portion, as shown in FIGS. 10 and 11. A member 80-1 with a high thermal expansion as one of the plates in FIG. 10 may be Ni-Cr-Fe alloy, Ni-Mn-Fe alloy, or Mn-Cu-Ni alloy. A member 80-2 with a low thermal expansion may be an alloy including Ni of 36 to 42% and Fe of 64 to 58%. Those materials are all ferromagnetic materials capable of leading a magnetic flux, flowing from the magnet to the pole piece through the bimetallic member 78 with little loss. In this respect, the use of those ferromagnetic materials is preferable but the bimetallic member 78 is not made of ferromagnetic material. When the bimetallic member 78 is made of a ferromagnetic material, part of the magnetic flux derived from the permanent magnet member 56 is led to the pole piece 24, through the bimetal member 78. Part of the magnetic flux from the permanent magnet member 56 is led through the gap G3 to the pole piece 24, however. Even if the bimetallic member 78 is made of ferromagnetic material, the gap G3 is included in the magnetic circuit. As seen, the gap G3 has a relatively large magnetic resistance, or reluctance, so that a change of the gap G3 causes the reluctance of the magnetic circuit to change. If the bimetallic member 78 may be made of non-magnetic material, the gap G3 is included in the magnetic circuit, apparently, so that a change of the gap G3 provides a change of the reluctance in the magnetic circuit.

In the embodiment in FIG. 9, since the permanent magnet member 56 is movable, the yoke 60 is comprised of a fixed yoke 60-1 and a movable yoke 60-2. The movable yoke 60-2 is in contact with the surface of the permanent magnet member 56, and is movably disposed within the fixed yoke 60-1. As well illustrated in FIG. 12, the side plate of the movable yoke 60-2 is slidably in contact with the inner surface of the fixed yoke 60-1. The side plate of the yoke 60-2 has a pair of pins 84 and 86 for holding a rod spring 82 and a cutaway portion 90 located between the pair of pins 84 and 86. A pin 88 mounted on the inner surface of the fixed yoke 60-1 is disposed in the cutaway portion 90, as shown. The rod spring 82 is held by the pins 84, 86 and 88, as shown, and provides a bias force to press the movable yoke 60-2 against the permanent magnet member 56. The movable yoke 60-2 is movable within a range defined by the upper portion 92 of the fixed yoke 60-1 and the pin 88. The movable range is determined by changes of the magnetic field intensity owing to a temperature rise of the permanent magnet or anode cylinder. The movable yoke 60-2 must have a face in contact with a face of with the fixed yoke 60-1 so that, even when the movable yoke 60-2 slides within the fixed yoke 60-1, no reluctance change occurs.

Figure 12:
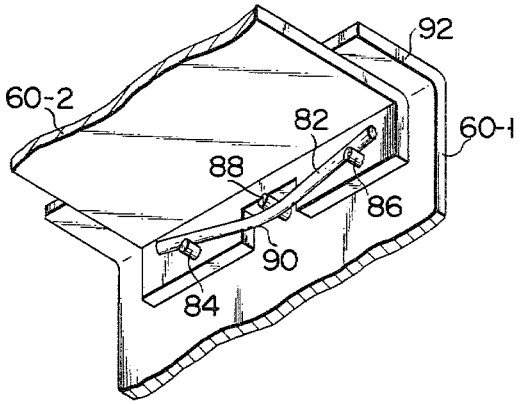
FIGS. 12 and 13 are diagrams of the structures of yokes used in the magnetron unit in FIG. 9.
Figure 13:
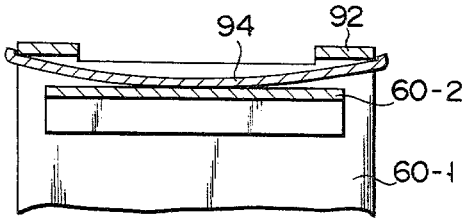

FIG. 13 shows a modification of the yoke structure shown in FIG. 12 and FIG. 9. The FIG. 13 embodiment employs a curved plate spring 94 in place of the pins 84, 86 and 88, and the rod spring 82 shown in FIG. 12. As shown, the plate spring 94 is fixed at both ends on the upper portions of the fixed yoke 60-1 and forcibly contacts at the central portion with the movable yoke 60-2 to bias the movable yoke downwardly. In FIG. 13, the permanent magnet member 56 is omitted for simplification.

The operation of the FIG. 9 embodiment will be described. With oscillation of the magnetron, temperature on the anode cylinder 8 and the pole piece 24 rise. The heat is transmitted to the ferrite permanent magnet member 56 to raise its temperature. Part of the heat thermally deforms the bimetallic member 78. In this embodiment, the inner surface of the bimetal member 78 is thermally expanded more than the outer surface thereof, so that the dish-like bimetallic member 78 is so deformed to be flat. By the deformation, the height (h) of the bimetallic member 78 is reduced while the interval between the pole piece 24 and the magnet member 56 is narrowed. As a result, the contact area between the bimetal member 78 and the magnet member 56 or the pole piece 24, increases to reduce a spatial volume of a space between the magnet member 56 and the pole piece 24. Accordingly, the reluctance between the magnet member 56 and the pole piece 24 decreases. In other words, the interval of the gap G3 corresponding to the height is reduced. In this way, the reduction of the magnetic force of the magnet member 56 due to temperature rise is offset by the decrease of the reluctance caused by the narrowed magnetic gap between the magnet member 56 and the pole piece 24, with the result that the magnetic field intensity in the electron interaction space is kept substantially constant.

The movement of the magnet member 56 caused by deformation of the bimetal member due to temperature rise is ensured by the bias force of the spring member 82 or 94. Additionally, the yoke 60 reliably contacts the magnet member 56 magnetically. Therefore, an intensity of the magnetic field in the interaction space can be kept substantially constant.

The description to follow is an elaboration of the means to adjust an intensity of the magnetic field in the magnetron unit shown in FIG. 1.

Figure 14:
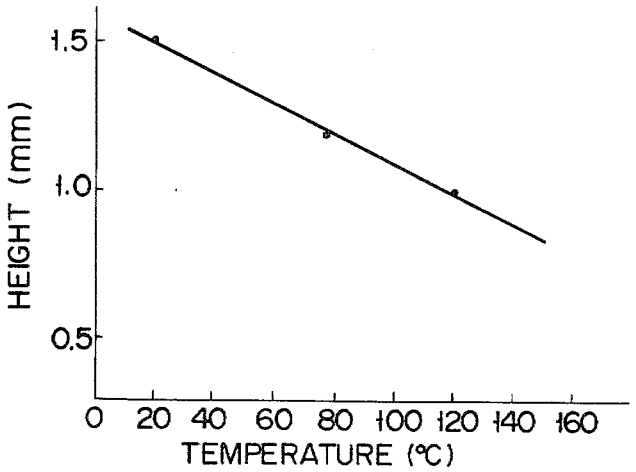
FIG. 14 is a graph showing a relationship between height (h) of the bimetallic member shown in FIG. 10 and the temperature.
Figure 15:
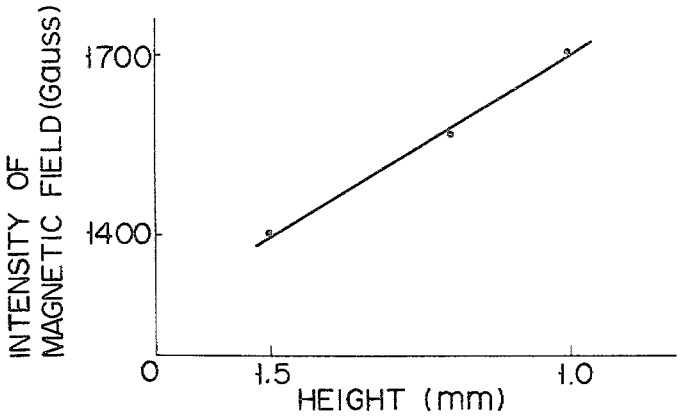
FIG. 15 is a graph showing a relationship between a magnetic field intensity in an interaction space and the height of the bimetallic member.
Figure 16:
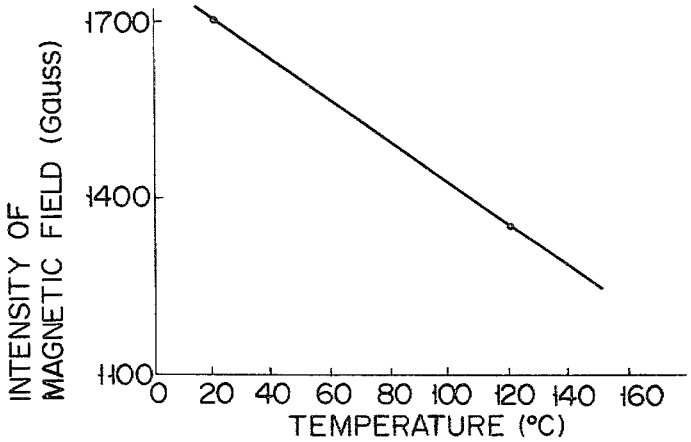
FIG. 16 is a graph showing a relationship between the magnetic field intensity in the interaction space and temperature of a ferrite magnet member of the magnetron unit which is not provided with the bimetallic member.
Figure 20:
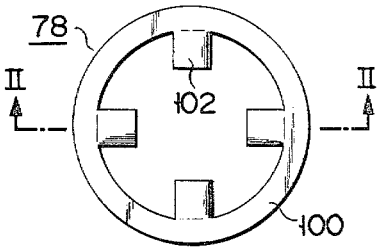

Consider a magnetron unit with an oscillating frequency of 2450 MHz and an output power of several hundred watts; with a ferrite magnet member 56 made of a doughnut shape and 20 mm in inner diameter, 50 mm in outer diameter and 10 mm in height (thickness). The bimetallic member has a configuration as shown in FIG. 10, and 20 mm in inner diameter (Di), 45 mm in outer diameter (Do), 1.5 mm in height (h) at normal temperature, and 1.0 mm in thickness (t). Experimentation has shown that the effects to be given later are attained. The height of the bimetallic member 78 is reduced by about 0.5 mm for about 100° C. of temperature rise, as shown in FIG. 14. An intensity of the center magnetic field in the interaction space increases from 1400 gauss to 1700 gauss when the height (h) is decreased by 0.5 mm, as shown in FIG. 15, in a condition that the temperature of the ferrite permanent magnet member 56 is fixed at normal temperature, the magnetomotive force is also fixed, and the height (h) of the bimetallic member is changed. The center magnetic field in the interaction space decreases from 1700 gauss to 1360 gauss when the temperature of the ferrite magnet member 56 of the magnetron unit, which is not provided with the bimetallic member, rises from normal temperature to 120° C., as shown in FIG. 16.

Figure 17:
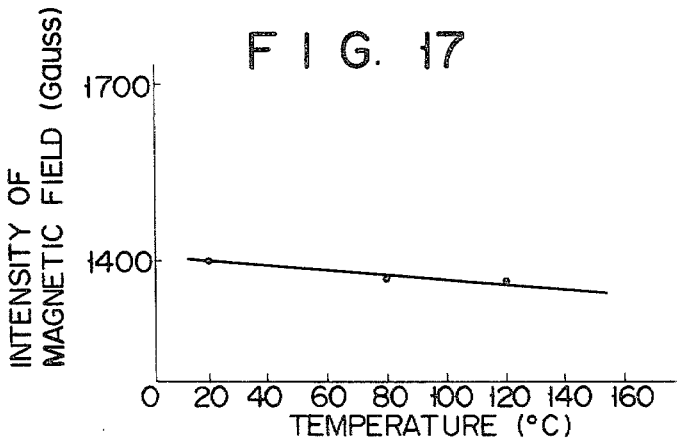
FIG. 17 is a graph showing a relationship between the magnetic field intensity in the interaction space and temperature of the ferrite magnet member of the magnetron according to this invention.

From the data, it is estimated that, when the bimetallic member is used, an extremely narrow range of 1400 gauss to 1350 gauss in the center magnetic field change is secured over a practical range of the temperature variation of the magnet, as shown in FIG. 17. The center magnetic field is change by the intermittent operation of the magnetron unit, but the amount of the change is negligible in a practical use.

In the FIG. 9 embodiment, the bimetallic member 78 is thermally coupled to the permanent magnet member 56 and the anode cylinder 8. Accordingly, the bimetallic member 78 is sensitive to the heat transmitted from the heat source, thus being little affected by temperature of the cooling air or the amount of the cooling air, and its height accurately changes with the temperature change of the anode cylinder 2 and the magnet member 56.

Figure 18:
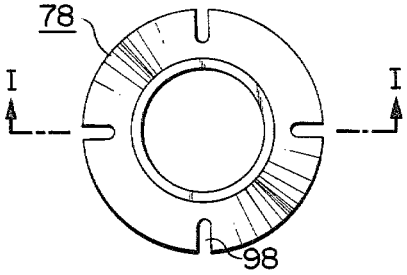
FIGS. 18 to 25 are diagrams of the bimetallic plates used in the magnetron unit according to the invention.
Figure 19:
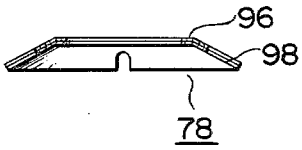

In order to reliably mount the magnet, a flat portion 96 may be provided along the top hole of the bimetallic member 78, as shown in FIGS. 18 and 19. Additionally, in order to make easy its height change with temperature, a number of slits 98 may be formed on the peripheral portion of the bimetallic member 78.

Figure 21:
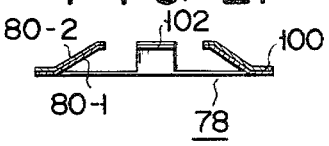

The bimetallic member 78 may be formed as shown in FIGS. 20 and 21, having a ring shaped portion 100 with a number of tongues extending radially toward the center thereof. The bimetallic member 78 is formed by bonding inner and outer plates 80-1, 80-2 the inner plate 80-1 being made of a low thermal expansion material and the outer plate 80-2 being made of high thermal expansion material.

Figure 22:
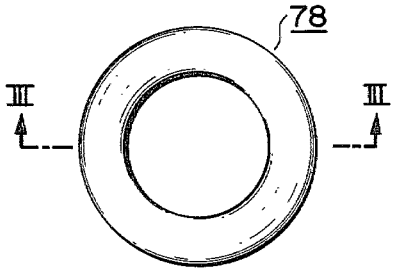
Figure 23:
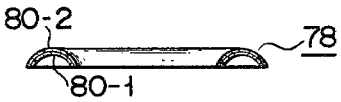

Another modification of the bimetallic member 78 is shown in FIGS. 22 and 23, having a ring shape as viewed in the plan view but an arch shape in the cross section. The modification is advantageous when it is used in a situation requiring a good restoring force for the bimetallic member. The bimetallic member 78 has the outer surface 80-2 of low expansion material and the inner surface 80-1 of high expansion material.

Figure 24:
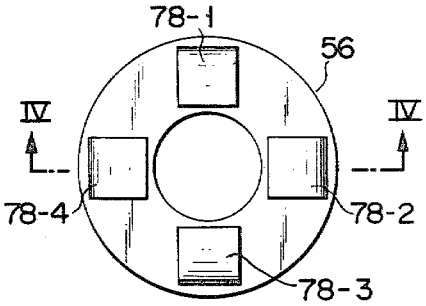
Figure 25:
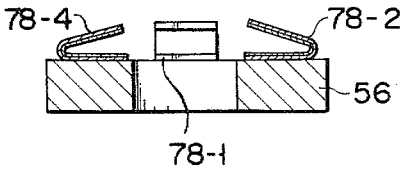

Yet another modification of the bimetallic member 78 is illustrated in FIGS. 24 and 25. The modification has a number of bimetallic members 78-1, 78-2, 78-3 and 78-4 on the magnet member 56. Each of the bimetallic members has a V-shape in cross section, as shown. Each bimetallic member is seated on the magnet member with the leg ends of the V close to the center, the top of the V close to the periphery of the magnet member. The outer surface of each bimetallic member is made of high expansion material and the inner surface thereof is made of low expansion material.

Figure 26:
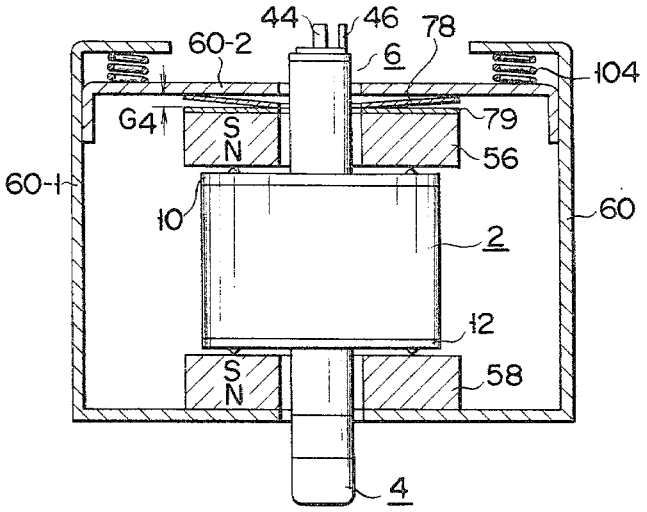
FIGS. 26 to 28 are longitudinal sectional views of the magnetron unit according to the invention.

A modification of the embodiment shown in FIG. 9 is shown in FIG. 26. The permanent magnet member 56 and the cover plate 10 have a gap therebetween with projections formed on the cover plate 10. A dish-like bimetallic member 78 is disposed between the permanent magnet member 56 and the movable yoke 60-2. The movable and the fixed yokes 60-1 and 60-2 have a spring coil 104 inserted therebetween to bias the movable yoke 60-2 thereby to reliably support the permanent magnet member 56 and the dish-like bimetallic member 78 between the movable yoke 60-2 and the cover plate 10. Additionally, the bimetallic member 78 may be in contact with the permanent magnet member 56 through a plate 79 made of ferromagnetic material provided on the surface of the permanent magnet member 56, and not directly in contact with the permanent magnet member 56.

In this modification, the bimetallic member 78 is not deformed by the heat from the anode cylinder 2, but is deformed by the heat from the permanent magnet member 56 which is heated by the anode cylinder 2 and by the heat from the magnetic yoke 60 which is heated by the anode cylinder 2 through the cooling fins (not shown in FIG. 26). The bimetallic member 78 is deformed in response to the thermal change of the permanent magnet member 56, and the magnetic gap G4 is changed in accordance with a change of the magnetomotive force of the permanent magnet member 56, thereby to keep the magnetic field in the interaction space substantially constant. The bimetallic member 78 has a displacement range from 0.5 to 1.0 mm, so that the spring coil 104 shown in FIG. 26 adjusts the movable yoke 60-2 within this range. The adjusting range is sufficiently small. Accordingly, the spring coil 104 may be replaced by the resilient material such as rubber. Further, the movable yoke 60-2 per se may have a resilient material without using the spring coil 104.

Figure 27:
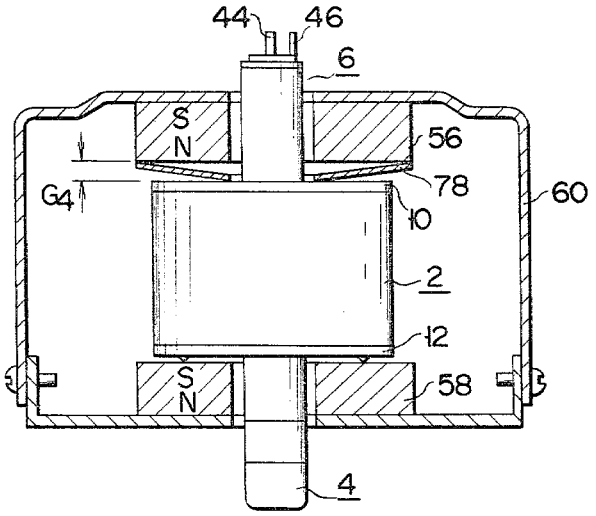

Another modification of the FIG. 9 embodiment is shown in FIG. 27. In this modification, the permanent magnet member 56 is directly in contact with the magnetic yoke 60 and the contact portion of the yoke 60 is a thin resilient material to supply a bias force to the permanent magnet member 56, thereby the member 56 being so maintained as to contact the bimetallic member 78. The contact portion of the yoke 60 may be made of magnetic material such as rubber containing ferrite.

Figure 28:
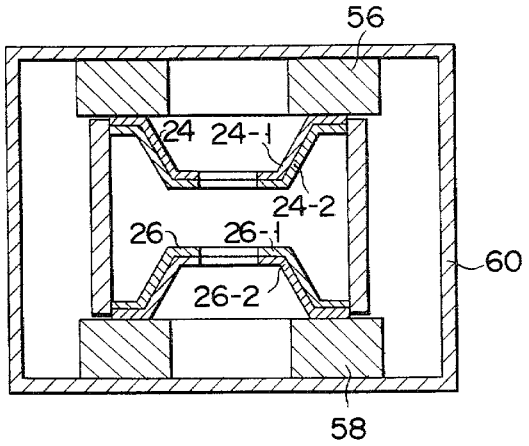

The magnetron unit of the invention may be modified as shown in FIG. 28. In this modification, a pair of the pole pieces 24 and 26 or either of those are made of bimetallic material. The pole piece 24 (26) has an inner surface 24-1 (26-1) of high expansion material and with an outer surface 24-2 (26-2) of low expansion material. At least one of them is made of ferromagnetic material. The structure shown in FIG. 28 is illustrated about only the necessary portions, for simplicity.

In operation, the oscillation of the magnetron unit produces heat which reduces the magnetomotive force of the permanent magnet members 56 and 58. On the other hand, the heat deforms the bimetallic pole piece 24 and 26 to narrow the interval between them. Therefore, the reduction of the magnetomotive force of the permanent magnet members 56 and 58 causing the decrease of the magnetic field intensity in the interaction space is compensated by an increase of the intensity of the magnetic field in the interaction space resulting from the narrowing of the interval between the pole pieces 24 and 26. As seen, the material of the pole pieces 24 and 26 and the thickness thereof are appropriately selected according to a magnetic field intensity change in the interaction space due to the reduction of the electromotive force of the permanent magnet members 56 and 58.

Figure 29:
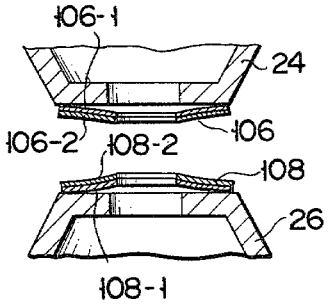
FIGS. 29 and 31 are diagrams of modifications of the embodiments shown in FIG. 28.

FIG. 29 shows a modification of the magnetron unit shown in FIG. 28. As shown, additional pole pieces 106 and 108 are mounted on the top ends of the pole pieces 24 and 26, respectively. The additional pole piece 106 (108) is made of bimetallic material, and its inner surface 106-1 (108-1) is made of high expansion material and its outer surface 106-2 (108-2) is made of low expansion material. Either of these is made of ferromagnetic material. The pole pieces 106 and 108 approach to each other when being heated to adjust the magnetic field intensity in the interaction space.

Figure 30:
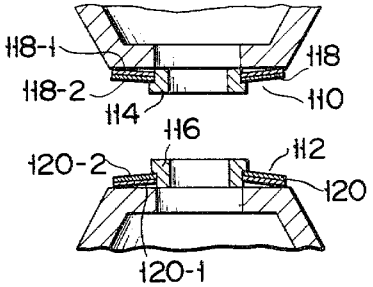
Figure 31:
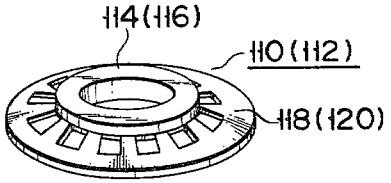

In another modification shown in FIG. 30 and FIG. 31 pole pieces 110 and 112 are additionally mounted on the top ends of the pole pieces 24 and 26, respectively. The pole piece 110 (112) has a ring member 114 (116) of ferromagnetic material, tongues radially disposed for supporting the ring member 114 (116), and a ring section 118 (120) integral with the tongues. The bimetallic member 118 (120) has a high expansion member 118-1 (120-1) and a low expansion member 118-2 (120-1). Neither of them must be of ferromagnetic material. Comparing with the magnetron unit of FIG. 29, the intensity of the magnetic field in the interaction space may be adjusted more finely.

As seen from the foregoing description, the magnetron unit of the invention may keep the intensity of the magnetic field in the interaction space substantially constant, thus having a stable characteristic.

What we claim is:

1. A magnetron unit comprising:

an anode cylinder provided with a number of resonance cavities defined therein;

a cathode disposed within the anode cylinder and along the axis of the anode cylinder, an interaction space being defined between the anode resonance cavities and the cathode;

at least one pole piece for supplying a magnetic field into the interaction space;

cover means for hermetically sealing the anode cylinder;

magnetic coupling means magnetically coupled with the pole piece;

at least one permanent magnet member magnetically coupled with the magnetic coupling means to supply magnetic energy to the pole piece, and disposed outside the anode cylinder, the permanent magnet member, the pole piece and interaction space being included in a magnetic circuit; and at least one bimetallic member for adjusting the magnetic resistance of the magnetic circuit to keep the magnetic field intensity in the interaction space substantially constant irrespective of the temperature of the permanent magnet member.

2. A magnetron unit according to claim 1, in which the pole piece is comprised of a fixed main pole piece and a movable auxiliary pole piece, and the bimetallic member moves the movable auxiliary pole in accordance with temperature of the permanent magnet member thereby to adjust the magnetic resistance.

3. A magnetron unit according to claim 2, in which the auxiliary pole piece is disposed close to the interaction space and is moved by the bimetallic member so as to approach to the interaction space with temperature rise within the anode cylinder.

4. A magnetron unit according to claim 2, in which the auxiliary pole piece is disposed on the surface of the main pole pieces at given intervals, and is moved by the bimetallic member so as to approach to the main pole pieces with temperature rise of the permanent magnet member.

5. A magnetron unit according to any one of claim 2 or 3 or 4, in which the auxiliary pole piece is supported by the bimetallic member.

6. A magnetron unit according to claim 2, in which the main pole piece is a dish-like member with a hole at the center, the auxiliary pole piece is a ring-like member disposed within the hole of the main pole piece and the bimetallic member is a bimetallic member is fixed at the outer peripheral edge to the main pole piece and fixed at the inner peripheral edge to the auxiliary pole piece thereby the auxiliary pole piece being supported.

7. A magnetron unit according to claim 2, further comprising means for restricting a displacement of the auxiliary pole piece.

* * * * *